US008950135B2

(12) United States Patent
Gaudreau et al.

(10) Patent No.: US 8,950,135 B2
(45) Date of Patent: Feb. 10, 2015

(54) CORNER ASSEMBLY FOR SIDING AND ROOFING COVERINGS AND METHOD FOR COVERING A CORNER USING SAME

(71) Applicant: Novik Inc., St-Augustin-de-Desmaures (CA)

(72) Inventors: Michel Gaudreau, Quebec (CA); Louis-Andre Gaudreau, Lac-Beauport (CA); Mathieu Piche, Quebec (CA); Martin Forget, Quebec (CA); Francois Bouchard, St-Redempteur (CA); Jon Paterson, Quebec (CA)

(73) Assignee: Novik Inc., St-Augustin-de-Desmaures, Quebec (CA)

( * ) Notice: Subject to any disclaimer, the term of this patent is extended or adjusted under 35 U.S.C. 154(b) by 0 days.

(21) Appl. No.: 14/134,424

(22) Filed: Dec. 19, 2013

(65) Prior Publication Data

US 2014/0165485 A1 Jun. 19, 2014

Related U.S. Application Data

(60) Provisional application No. 61/739,322, filed on Dec. 19, 2012.

(51) Int. Cl.

| | |
|---|---|
| ***E04F 13/073*** | (2006.01) |
| ***E04D 13/158*** | (2006.01) |
| ***E04F 13/18*** | (2006.01) |

(52) U.S. Cl.

CPC ..... *E04F 13/0733* (2013.01); *E04D 13/158* (2013.01); *E04F 13/185* (2013.01)

USPC ..... 52/288.1; 52/311.2; 52/314; 52/532; 52/535; 52/592.1

(58) Field of Classification Search

CPC ..... E04D 1/26; E04D 2001/005; E04D 2001/305; E04C 2/30; E04C 2002/007; E04B 2/7425; E04B 2002/725; E04F 13/072; E04F 13/073; E04F 13/076; E04F 13/14

USPC ..... 52/287.1, 288.1, 311.1, 311.2, 314, 52/518–520, 532, 535, 536, 591.1, 591.4, 52/592.1

See application file for complete search history.

(56) References Cited

U.S. PATENT DOCUMENTS

| | | | | |
|---|---|---|---|---|
| 448,733 | A | 3/1891 | Sagendorph | |
| 457,310 | A * | 8/1891 | Ewing | 52/311.2 |
| 637,212 | A * | 11/1899 | MoCune | 52/284 |

(Continued)

OTHER PUBLICATIONS http://www.ecostar.carlisle.com/PDFs/majestic-install-guide.pdf Copyright 2005.

*Primary Examiner* — Adriana Figueroa
(74) *Attorney, Agent, or Firm* — Merchant & Gould P.C.

(57) ABSTRACT

A corner assembly for siding and roofing coverings includes two complementary corner molding members, each one of the two corner molding members having a front wall including a covering section with simulated building elements on an outer face thereof. Each one of the two corner molding members further has at least one protruding finger and at least one recess. The at least one protruding finger and at least one recess are configured in an alternate configuration in order to interlock in a male-female configuration when the two complementary corner molding members are engaged with one another to define a corner. A method covers a length of a corner defined at a junction of a first support surface and a second support surface.

22 Claims, 6 Drawing Sheets

(56) References Cited

U.S. PATENT DOCUMENTS 1,447,567 A 3/1923 Overbury
1,467,510 A 9/1923 Smith, Jr.
1,701,704 A 2/1929 Stinson
1,767,374 A 6/1930 Kirschbraun
1,795,913 A 3/1931 Weaver
1,886,363 A 11/1932 Aufderheide
2,006,635 A 7/1935 Farr
2,018,216 A 10/1935 Maclean
2,096,968 A 10/1937 Johnston
2,156,277 A 5/1939 Corbin, Jr.
2,649,172 A * 8/1953 Allen ..... 52/591.4
2,673,459 A * 3/1954 Overhulse ..... 52/259
2,766,861 A 10/1956 Abramson
3,217,453 A 11/1965 Medow
3,417,531 A 12/1968 Jones
3,430,395 A 3/1969 Lashkow
3,504,467 A 4/1970 Hatch
3,593,479 A 7/1971 Hinds et al.
3,754,366 A 8/1973 Jansson et al.
3,783,570 A 1/1974 Storch
3,895,469 A 7/1975 Kapitan
3,968,610 A 7/1976 Medow
3,973,369 A 8/1976 Smith
3,977,145 A 8/1976 Dobby
4,015,391 A 4/1977 Epstein
4,033,499 A 7/1977 Butler
4,034,528 A 7/1977 Sanders et al.
4,070,432 A 1/1978 Tamaddon
4,070,843 A 1/1978 Leggiere et al.
4,096,679 A 6/1978 Naz
4,104,841 A 8/1978 Naz
4,186,538 A 2/1980 Marcum, Jr.
4,189,878 A 2/1980 Fitzgerald et al.
4,219,981 A 9/1980 Stewart et al.
4,251,967 A 2/1981 Hoofe, III
4,275,540 A * 6/1981 Keller ..... 52/314
4,288,959 A 9/1981 Murdock
4,310,370 A 1/1982 Arai et al.
4,319,439 A 3/1982 Gussow
4,343,126 A 8/1982 Hoofe, III
4,382,993 A 5/1983 McIntyre et al.
4,434,200 A 2/1984 Fash et al.
4,437,602 A 3/1984 Kaczmarek
4,445,301 A 5/1984 Tanski
4,472,913 A 9/1984 Hickman
4,476,661 A 10/1984 Hoofe, III
4,498,267 A 2/1985 Beck
4,499,702 A 2/1985 Turner
4,522,002 A 6/1985 Davis
4,544,595 A 10/1985 Tomason
4,580,383 A 4/1986 Pittman et al.
4,588,634 A 5/1986 Pagen et al.
4,592,185 A 6/1986 Lynch et al.
4,593,512 A 6/1986 Funaki
4,598,522 A 7/1986 Hoofe, III
4,617,770 A 10/1986 Hickman
4,617,774 A 10/1986 Pittman et al.
4,618,440 A 10/1986 Steinberg et al.
4,627,207 A 12/1986 Young et al.
4,641,472 A 2/1987 Young et al.
4,663,373 A 5/1987 Ravichandran et al.
4,671,753 A 6/1987 Payne
4,671,991 A 6/1987 Payne
4,680,911 A 7/1987 Davis et al.
4,712,351 A 12/1987 Kasprzak
4,717,614 A 1/1988 Bondoc et al.
4,729,202 A 3/1988 Ferland
4,749,533 A 6/1988 Payne
4,777,776 A 10/1988 Morrell
4,782,638 A 11/1988 Hovind
4,795,661 A 1/1989 Bondoc et al.
4,798,033 A 1/1989 Weidl
4,803,144 A 2/1989 Hosoi
4,825,616 A 5/1989 Bondoc et al.
4,827,683 A * 5/1989 Poole ..... 52/316
4,864,787 A * 9/1989 Bukowski ..... 52/284
4,879,333 A 11/1989 Frazee
4,890,432 A 1/1990 Shepherd
4,936,071 A 6/1990 Karralt
4,940,844 A 7/1990 Blunt
4,946,992 A 8/1990 Falk et al.
5,039,740 A 8/1991 Anderson et al.
5,047,556 A 9/1991 Kohler et al.
5,060,444 A 10/1991 Paquette
5,076,037 A 12/1991 Crick et al.
5,084,506 A 1/1992 Faler et al.
5,088,910 A 2/1992 Goforth et al.
5,096,046 A 3/1992 Goforth et al.
5,100,274 A 3/1992 Hasan et al.
5,106,609 A 4/1992 Bolich, Jr. et al.
5,124,098 A 6/1992 Vischer
5,126,392 A 6/1992 Nakashima et al.
5,135,971 A 8/1992 Steiert et al.
5,141,983 A 8/1992 Hasegawa et al.
5,186,980 A 2/1993 Koschitzky
5,188,895 A 2/1993 Nishino et al.
5,224,318 A 7/1993 Kemerer
5,229,207 A 7/1993 Paquette et al.
D339,875 S 9/1993 Schutz et al.
5,249,402 A 10/1993 Crick et al.
5,287,669 A 2/1994 Hannah et al.
5,288,787 A 2/1994 Sackmann et al.
5,295,339 A 3/1994 Manner
5,305,569 A 4/1994 Malmquist et al.
5,305,570 A 4/1994 Rodriguez et al.
5,344,007 A 9/1994 Nakamura et al.
5,347,784 A 9/1994 Crick et al.
5,349,802 A 9/1994 Kariniemi
5,363,623 A 11/1994 King
5,375,491 A 12/1994 Hannah et al.
5,400,558 A 3/1995 Hannah et al.
RE34,951 E 5/1995 Slosberg et al.
5,416,151 A 5/1995 Tanaka
5,421,134 A 6/1995 Hannah et al.
5,437,735 A 8/1995 Younan et al.
5,444,954 A 8/1995 Anderson
5,501,056 A 3/1996 Hannah et al.
5,524,412 A 6/1996 Corl
5,537,792 A 7/1996 Moliere
5,575,861 A 11/1996 Younan et al.
5,577,361 A 11/1996 Grabek, Jr.
5,592,799 A 1/1997 Reinke
5,613,337 A 3/1997 Plath et al.
5,622,020 A 4/1997 Wood
5,636,481 A 6/1997 De Zen
5,644,886 A 7/1997 Ekmark et al.
5,675,955 A 10/1997 Champagne
5,687,090 A 11/1997 Chen et al.
5,711,126 A * 1/1998 Wells ..... 52/519
5,731,033 A 3/1998 Hanisco
5,763,083 A 6/1998 Berrigan
5,784,848 A 7/1998 Toscano
5,813,184 A 9/1998 McKenna
5,821,294 A 10/1998 Perlinski
5,836,123 A * 11/1998 Gulino ..... 52/288.1
5,853,858 A 12/1998 Bondoc
5,878,543 A 3/1999 Mowery
5,916,100 A 6/1999 Mitchell et al.
5,922,379 A 7/1999 Wang
5,956,914 A 9/1999 Williamson
5,960,596 A 10/1999 Lyons, Sr.
5,992,116 A 11/1999 Ternes et al.
6,038,827 A 3/2000 Sieling
6,044,609 A 4/2000 Kim
6,045,290 A * 4/2000 Nocievski ..... 403/231
6,050,041 A 4/2000 Mowery et al.
6,052,961 A 4/2000 Gibbs
6,058,670 A 5/2000 Sieling et al.
6,082,064 A 7/2000 Mitchell et al.
6,092,302 A 7/2000 Berrigan
6,105,329 A 8/2000 Bondoc et al.
6,114,007 A 9/2000 Brandon et al.
6,122,878 A 9/2000 Pliley
6,153,293 A 11/2000 Dahl et al.

(56) References Cited

U.S. PATENT DOCUMENTS

| | | | | |
|---|---|---|---|---|
| 6,180,257 | B1 | 1/2001 | Brandt et al. | |
| 6,224,701 | B1 | 5/2001 | Bryant et al. | |
| 6,248,813 | B1 | 6/2001 | Zehner | |
| 6,258,876 | B1 | 7/2001 | Medoff et al. | |
| 6,282,858 | B1 | 9/2001 | Swick | |
| 6,295,777 | B1 | 10/2001 | Hunter et al. | |
| 6,301,856 | B1 | 10/2001 | Nasi | |
| 6,336,303 | B1 | 1/2002 | Vandeman et al. | |
| 6,357,194 | B1 * | 3/2002 | Jones, Jr. | 52/590.1 |
| 6,360,508 | B1 | 3/2002 | Pelfrey et al. | |
| 6,361,851 | B1 | 3/2002 | Sieling et al. | |
| 6,421,975 | B2 | 7/2002 | Bryant et al. | |
| 6,427,414 | B1 * | 8/2002 | Wing | 52/590.1 |
| 6,436,471 | B1 | 8/2002 | Petersen | |
| 6,453,973 | B1 * | 9/2002 | Russo | 160/135 |
| 6,487,828 | B1 | 12/2002 | Phillips | |
| 6,526,712 | B2 * | 3/2003 | Brooks et al. | 52/287.1 |
| 6,550,362 | B1 | 4/2003 | Galinat et al. | |
| 6,579,605 | B2 | 6/2003 | Zehner | |
| 6,711,860 | B2 * | 3/2004 | Fleishman | 52/81.3 |
| 6,715,240 | B2 | 4/2004 | Beck et al. | |
| 6,715,250 | B2 | 4/2004 | Bryant et al. | |
| 6,786,804 | B2 | 9/2004 | Watanabe | |
| D507,837 | S | 7/2005 | King | |
| 6,939,036 | B2 | 9/2005 | Beck et al. | |
| 6,955,019 | B2 | 10/2005 | Donlin et al. | |
| 6,976,342 | B1 | 12/2005 | Kowalevich | |
| 6,983,571 | B2 | 1/2006 | Felton | |
| 6,988,345 | B1 | 1/2006 | Pelfrey et al. | |
| 7,008,213 | B2 | 3/2006 | King | |
| 7,089,709 | B2 | 8/2006 | Waggoner | |
| 7,159,367 | B1 * | 1/2007 | King | 52/314 |
| 7,207,145 | B2 | 4/2007 | Stucky et al. | |
| 7,240,461 | B1 | 7/2007 | Vandeman et al. | |
| 7,272,913 | B2 | 9/2007 | Mitchell | |
| D569,014 | S * | 5/2008 | Coates | D25/139 |
| D573,726 | S * | 7/2008 | Coates | D25/139 |
| 7,698,865 | B2 | 4/2010 | Pringle et al. | |
| 7,739,848 | B2 | 6/2010 | Trout | |
| 7,775,008 | B2 | 8/2010 | King | |
| 7,775,009 | B2 | 8/2010 | King | |
| 7,797,896 | B2 * | 9/2010 | Miller et al. | 52/233 |
| 7,861,476 | B2 * | 1/2011 | Bezubic, Jr. | 52/288.1 |
| 7,997,044 | B2 * | 8/2011 | Green et al. | 52/834 |
| 8,209,938 | B2 | 7/2012 | Gaudreau et al. | |
| 8,402,707 | B2 * | 3/2013 | Mitchell et al. | 52/288.1 |
| 2001/0039778 | A1 | 11/2001 | King | |
| 2002/0098110 | A1 | 7/2002 | Graham et al. | |
| 2003/0182888 | A1 | 10/2003 | Desbois et al. | |
| 2004/0065031 | A1 * | 4/2004 | Steinberg et al. | 52/287.1 |
| 2006/0032527 | A1 | 2/2006 | Stevens et al. | |
| 2006/0162277 | A1 | 7/2006 | Schultz | |
| 2006/0260247 | A1 * | 11/2006 | Monteer | 52/520 |
| 2007/0107356 | A1 | 5/2007 | Steffes et al. | |
| 2007/0144096 | A1 | 6/2007 | O'Neal | |
| 2008/0083186 | A1 | 4/2008 | Gaudreau | |
| 2008/0083188 | A1 | 4/2008 | Swanson | |
| 2008/0098683 | A1 | 5/2008 | Trabue et al. | |
| 2010/0088988 | A1 | 4/2010 | Gaudreau | |
| 2010/0236175 | A1 * | 9/2010 | King | 52/314 |
| 2011/0023396 | A1 | 2/2011 | Schwarz et al. | |

* cited by examiner

CORNER ASSEMBLY FOR SIDING AND ROOFING COVERINGS AND METHOD FOR COVERING A CORNER USING SAME

CROSS REFERENCE TO RELATED APPLICATION

This application claims the benefit under 35 U.S.C. §119 (e) of U.S. provisional patent application No. 61/739,322 which was filed on Dec. 19, 2012. The entirety of the aforementioned application is herein incorporated by reference.

FIELD OF THE INVENTION

The present invention relates to the field of roof and wall coverings including simulated building elements. More particularly, it relates to the field of corner assemblies for siding and roofing coverings and to methods for covering a length of corner of a support surface using same.

BACKGROUND

Siding and roofing coverings, made of synthetic materials and designed for facing exterior building walls and roofs, are known in the art. For example, such coverings can have the appearance of natural materials, such as wooden clapboards, cedar shakes, masonry (stones, bricks, etc.) and the like. In typical embodiments, the coverings include a plurality of elongated panels which are individually affixed to support surfaces such as building walls or roofs. Normally, the elongated panels are secured to the support surfaces, in horizontal courses, beginning with the lowermost course, using nails or screws.

As will be easily understood, at corners of the support surfaces of the building or structure to which the panels are mounted, joints are formed between the elongated panels affixed thereon. In order to hide these joints, it is known to cover the corner sections with vertical elongated corner moldings (or corner trims). Known corner moldings however tend to pose aesthetic issues, as they are often unaesthetic and can lessen the natural appearance of the coverings. Moreover, in certain cases, the corner assemblies are cumbersome to assemble and/or to secure to the support surface or covering surface. Furthermore, known corner moldings are commonly designed to cover a predefined corner angle and are not adapted to cover a range of corner angles. In addition, different corner moldings are usually required depending on whether the corner is an inside corner or an outside corner.

In view of the above, there is a need for an improved corner assembly for siding and roofing coverings which, by virtue of its design and components, would be able to overcome or at least minimize some of the above-discussed prior art concerns.

SUMMARY OF THE INVENTION

According to a first general aspect, there is provided a corner assembly for siding and roofing coverings. The corner assembly comprises two complementary corner molding members, each one of the two corner molding members having a front wall including a covering section with simulated building elements on an outer face thereof. Each one of the two corner molding members further has at least one protruding finger and at least one recess. The at least one protruding finger and at least one recess are configured in an alternate configuration in order to interlock in a male-female configuration when the two complementary corner molding members are engaged with one another to define a corner.

In an embodiment, the two complementary corner molding members are selectively engageable in an inside corner configuration and an outside corner configuration.

In an embodiment, each one of the two complementary corner molding members further comprises outer sidewall sections extending inwardly from the front wall, at an end of each one of the at least one protruding finger and the at least one recess, each one of the two complementary corner molding members further comprising a lip extending outwardly from an inner edge of each one of the outer sidewall sections corresponding to the at least one recess.

In an embodiment, each one of the two complementary corner molding members further comprises a plurality of inner walls extending inwardly from the front wall, each one of the inner walls having at least one indentation defined therein engageable by a respective one of the lips of the other one of the corner molding members when the two complementary corner molding members are engaged in an outside corner configuration.

In an embodiment, the covering section with simulated building elements covers each one of the outer sidewall sections corresponding to the at least one protruding finger.

In an embodiment, at least one of the two complementary corner molding members further comprises a U-shaped wall extension extending from one of an upper edge and a lower edge thereof.

In an embodiment, each one of the two complementary corner molding members further comprises an inner sidewall extending inwardly from the front wall, at an end opposed to the at least one protruding finger and the at least one recess, the inner sidewall including a fastening flange extending outwardly from an inner edge thereof.

In an embodiment, the fastening flange comprises a plurality of fastening apertures.

In an embodiment, the two complementary corner molding members are identical, one of the two complementary corner molding members being flipped upside-down prior to the engagement of the two complementary corner molding members.

According to another general aspect, there is also provided a corner assembly for siding and roofing coverings. The corner assembly comprises a first corner molding member and a second corner molding member, each one of the first corner molding member and the second corner molding member having an external face including a covering section with simulated building elements. Each one of the first corner molding member and the second corner molding member further has at least one protruding finger and at least one recess defining a toothed edge region, the at least one protruding finger and the at least one recess being configured in an alternate configuration. The first corner molding member and the second corner molding member are engageable together in a finger joint configuration wherein each of the at least one protruding finger of the first corner molding member is engaged in a respective one of the at least one recess of the second corner molding member and each of the at least one protruding finger of the second corner molding member is engaged in a respective one of the at least one recess of the first corner molding member to define a corner.

In an embodiment, the first corner molding member and the second corner molding member are selectively engageable in an inside corner configuration and an outside corner configuration.

In an embodiment, each one of the first corner molding member and the second corner molding member further comprises a lip extending outwardly from an inner edge of each one of the at least one recess of the toothed edge region.

In an embodiment, each one of the first corner molding member and the second corner molding member further comprises a plurality of inner walls having at least one indentation defined therein engageable by a respective one of the lips of the other one of the first corner molding member and the second corner molding member when the first corner molding member and the second corner molding member are engaged in an outside corner configuration.

In an embodiment, at least one of the first corner molding member and the second corner molding member further comprises a U-shaped wall extension extending from one of an upper edge and a lower edge thereof.

In an embodiment, each one of the first corner molding member and the second corner molding member further comprises a fastening flange extending outwardly from an inner edge of an edge region opposed and spaced-apart from the toothed edge region.

In an embodiment, the fastening flange comprises a plurality of fastening apertures.

In an embodiment, the first corner molding member and the second corner molding member are identical, one of the first corner molding member and the second corner molding member being flipped upside-down prior to the engagement of the two complementary corner molding members.

According to yet another general aspect, there is also provided a method for covering a length of a corner defined at a junction of a first support surface and a second support surface, the method comprises the step of assembling a corner assembly by engaging a first corner molding member and a second corner molding member together. The corner molding members are engaged by interlocking at least one protruding finger and at least one recess of the first corner molding member with at least one corresponding protruding finger and at least one corresponding recess of the second corner molding member. The method comprises the further steps of configuring the corner assembly in one of an inside corner configuration and an outside corner configuration and securing the corner assembly to the first support surface and the second support surface to cover the junction thereof.

In an embodiment, the method further comprises the steps of: assembling an additional corner assembly by engaging a third corner molding member and a fourth corner molding member together; configuring the additional corner assembly in one of the inside corner configuration and the outside corner configuration; positioning the additional corner assembly in a vertically-adjacent position with the previously secured corner assembly; and securing the additional corner assembly to the first support surface and the second support surface to cover the junction thereof. The corner molding members are engaged by interlocking at least one protruding finger and at least one recess of the third corner molding member with at least one corresponding protruding finger and at least one corresponding recess of the fourth corner molding member.

In an embodiment, the steps are repeated until the length is covered.

In an embodiment, the step of positioning the additional corner assembly in a vertically-adjacent position with the previously secured corner assembly comprises the additional step of inserting at least one U-shaped wall extension extending from at least one of the previously secured corner assembly and the additional corner assembly behind the other one of the at least one of the previously secured corner assembly and the additional corner assembly.

For the sake of simplicity, in the course of the present document, the expression "inward" refers to the direction towards the support surface in reference to an engaged position of the corner assembly irrespective of whether it is currently engaged on the support surface or not. Moreover, the term "inner edge" refers to an edge of a wall of the corner assembly proximate to the support surface when a corner molding member of the corner assembly is positioned to be secured thereto.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the corner assembly for siding and roofing coverings and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the corner assembly for siding and roofing coverings, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
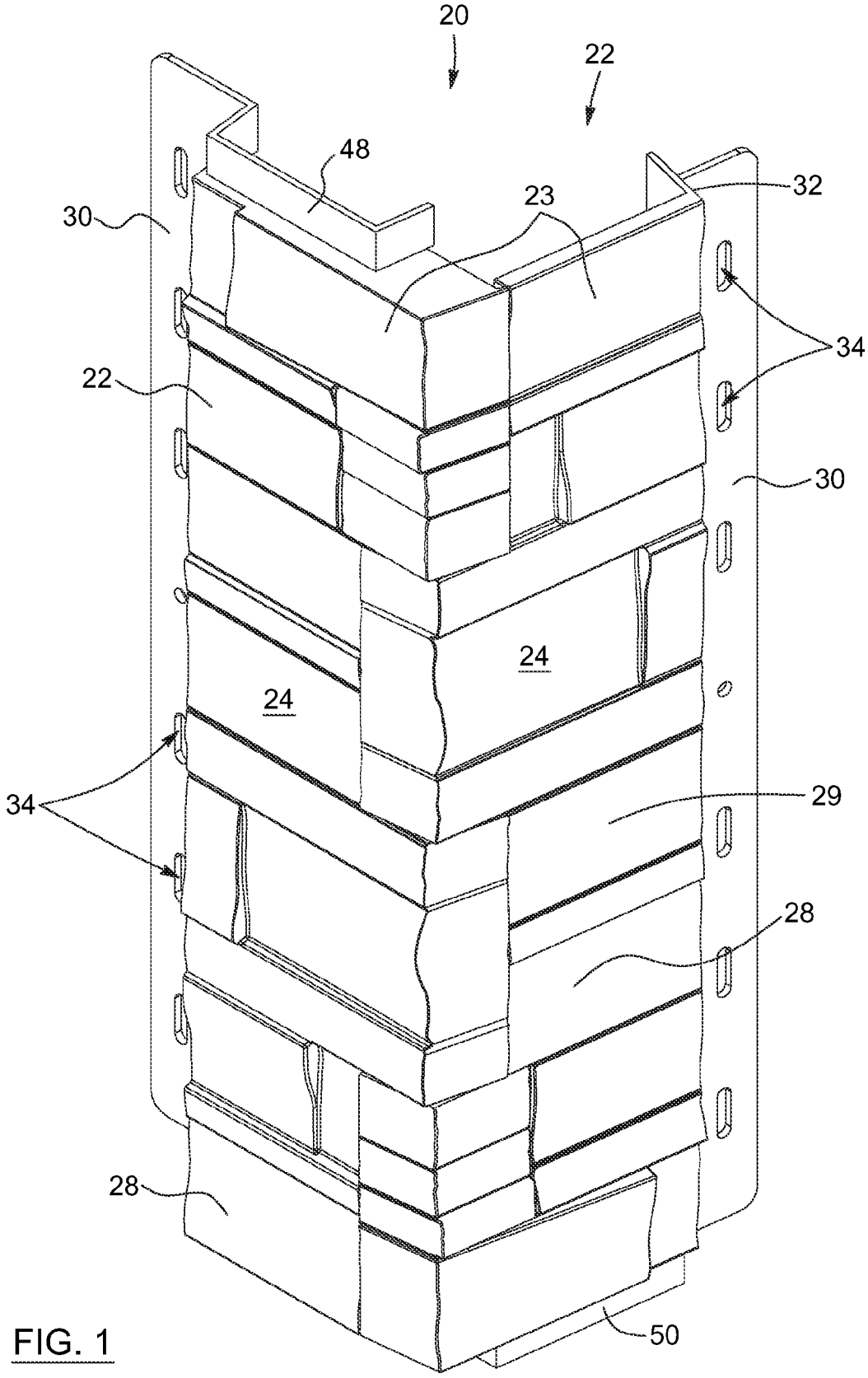
FIG. 1 is a front perspective view of a corner assembly of a covering system in accordance with an embodiment, wherein the corner assembly includes two complementary corner molding members configured in an outside corner configuration.

Referring generally to FIG. 1, in accordance with one embodiment, there is provided a corner assembly 20 of a siding and roofing covering system (not shown). In the illustrated embodiment, and as will be described in more details below, the corner assembly 20 includes two complementary corner molding members 22 with inter-woven fingers 36

(FIG. 2) and could therefore be described as a two-part, finger-jointed corner assembly for siding and roofing covering systems.

It will be understood that, as previously mentioned, the corner assembly 20 is designed to be part of a covering system for building structure walls and roofs (not shown). The covering system typically includes a plurality of panels (not shown) mounted to a support surface (not shown), in addition to at least one corner assembly 20 as described herein. In an embodiment, the covering system may include a plurality of corner assemblies 20 mounted in a vertically stacked relation to each other, i.e. each corner assembly 20 being vertically-adjacent to another corner assembly 20, in order to cover an entire length of a corner of the building structure. The panels are mounted laterally to the sides of the at least one corner assembly 20.

Figure 6:
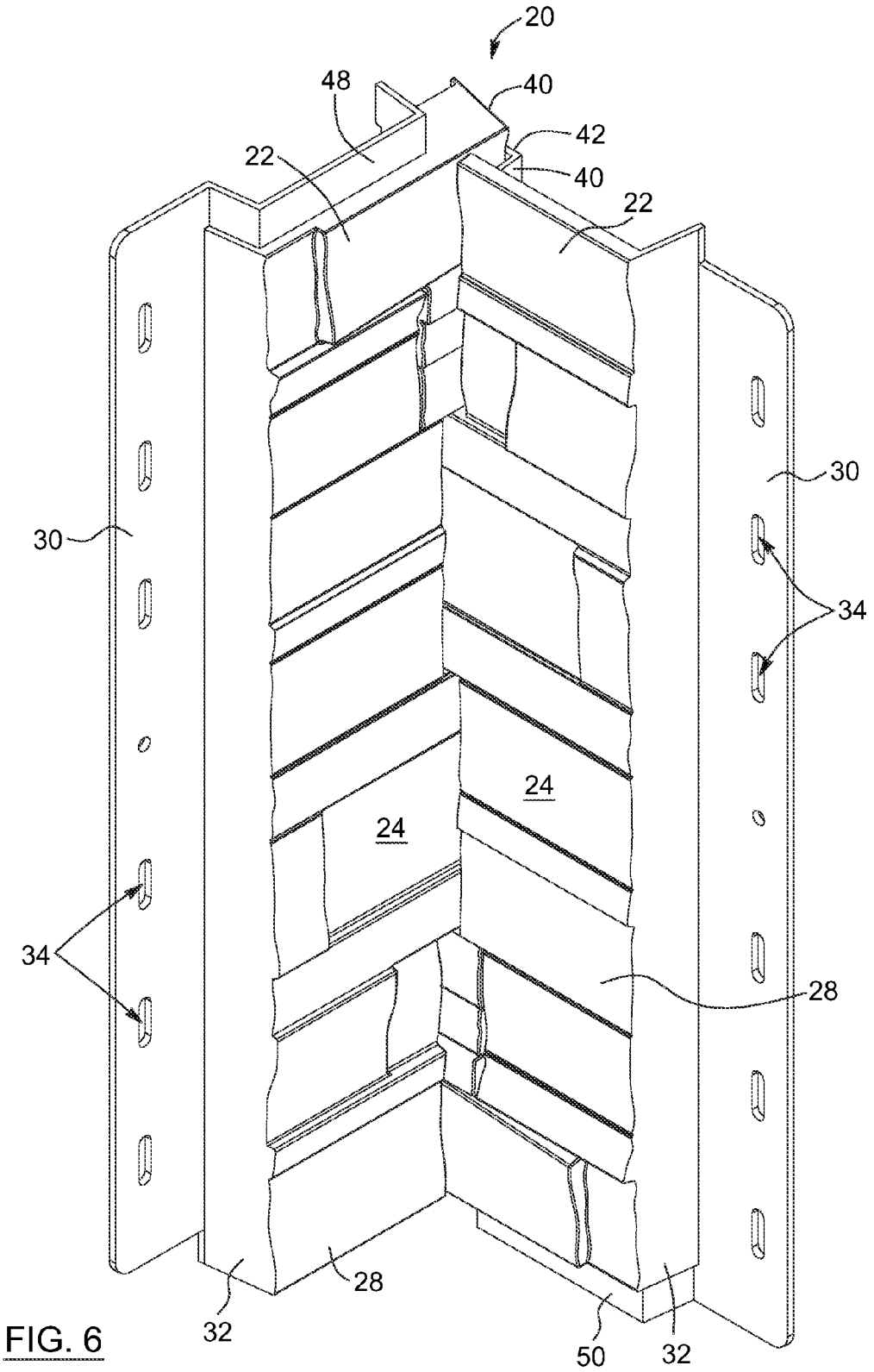
FIG. 6 is a front perspective view of the corner assembly shown in FIG. 1, wherein the two complementary corner molding members are configured in an inside corner configuration.

As can be clearly seen in FIGS. 1 and 6, each corner assembly 20 is configured to cover a length of a corner of a building structure (not shown), i.e. the area wherein two support surfaces meet at a non-zero angle (or non-straight angle). It will be understood that the two corner molding members 22 of the corner assembly 20 can be engaged together to define an outside corner, as shown in the embodiment of FIG. 1, or to define an inside corner, as shown in the embodiment of FIG. 6.

The corner molding members 22 of each corner assembly 20 may be formed of any material known to be suited to use as a covering material for building structures. For example and without being limitative, in an embodiment, the corner molding members 22 may be made of a polymeric material. Moreover, one skilled in the art would understand that while each corner molding member 22 shown in the exemplary embodiment is monolithic, such a construction is only representative of an embodiment and that, in an alternative embodiment, each corner molding member 22 may be a unitary element fashioned from two or more separate constituent components.

Figure 2:
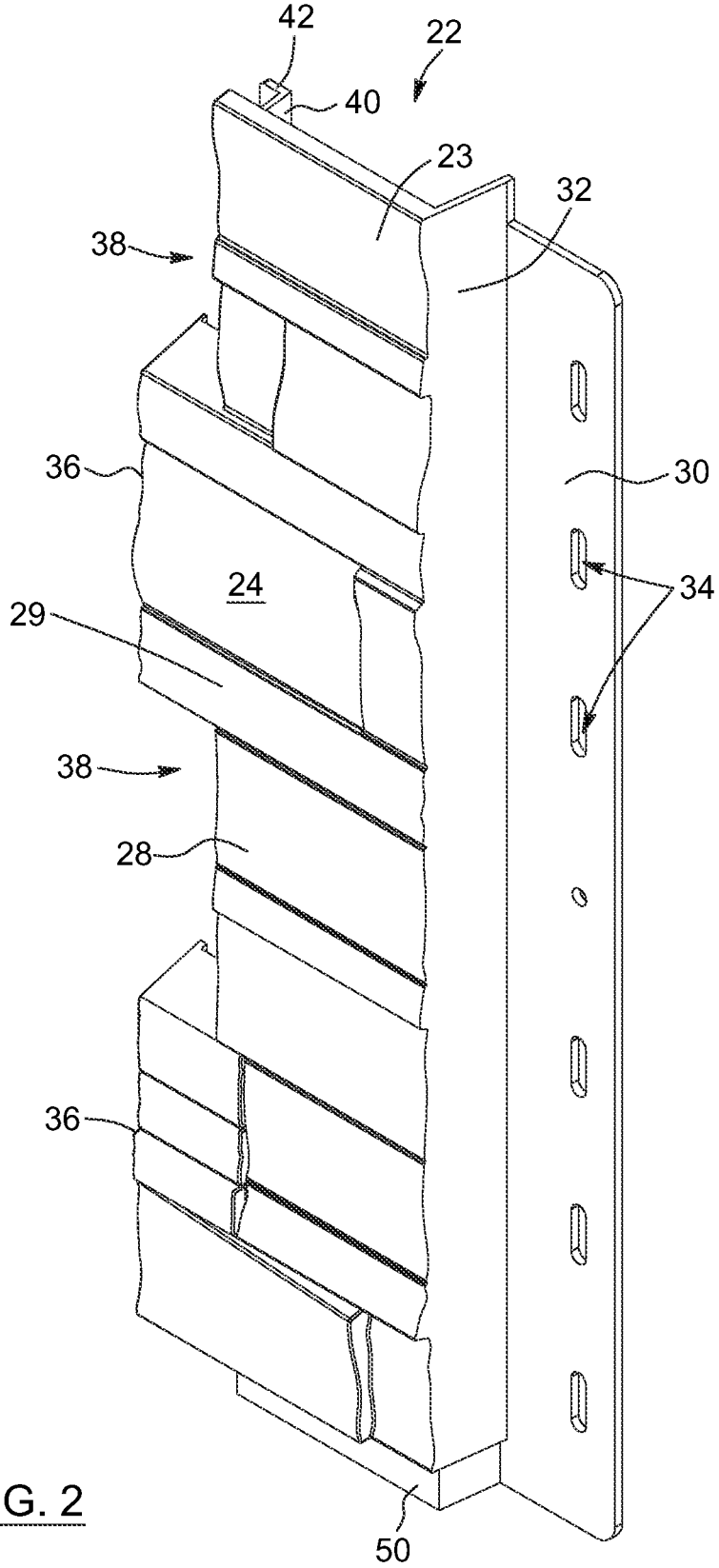
FIG. 2 is a front perspective view of one of the corner molding members of the corner assembly shown in FIG. 1.
Figure 3:
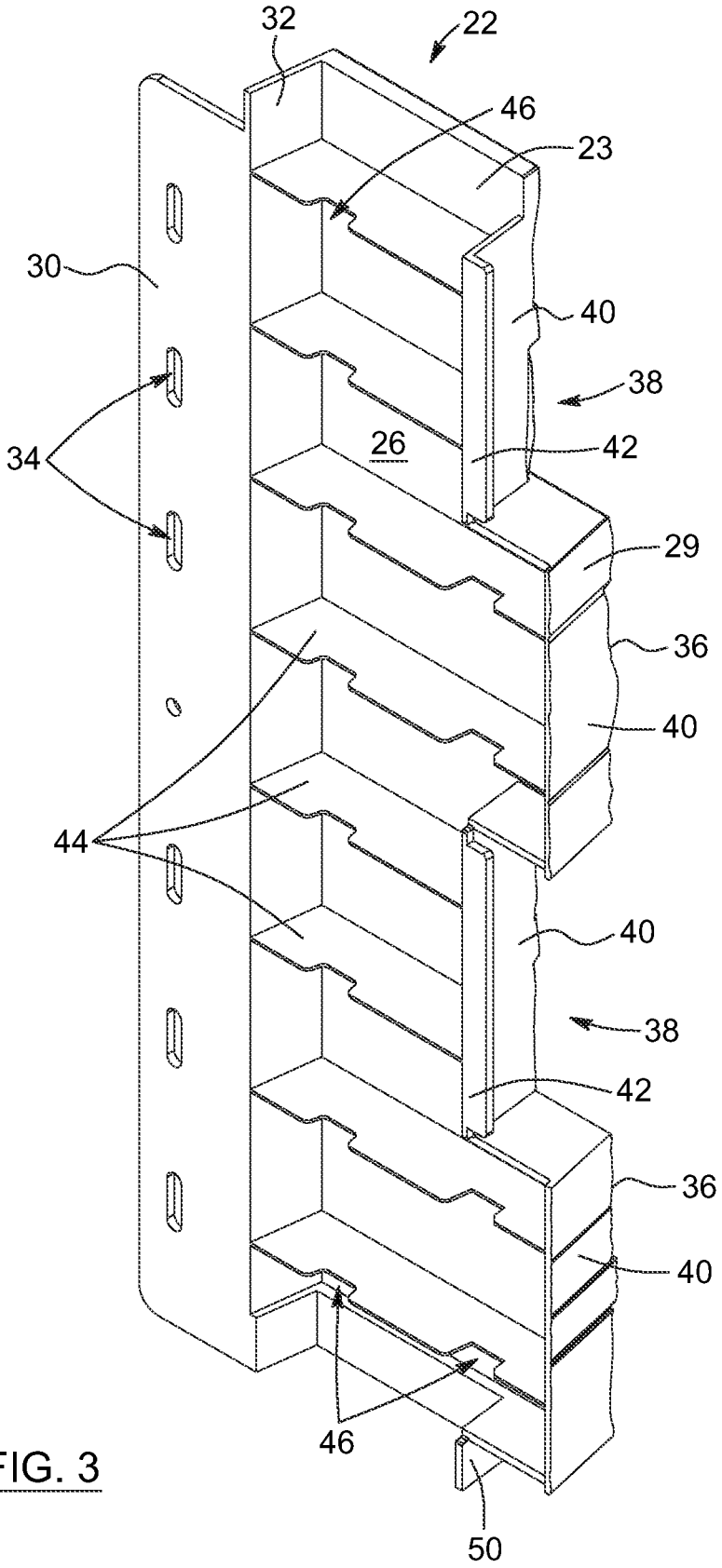
FIG. 3 is a rear perspective view of the corner molding member shown in FIG. 2.

Referring now to FIGS. 2 and 3, one of the corner molding members 22 of the corner assembly 20 will be described in more details. In the illustrated embodiment, the corner molding member 22 includes a front (covering) wall 23 having an outer face 24 and an opposed inner face 26, as well as an inner sidewall 32 and opposed outer sidewall sections 40, extending inwardly, substantially perpendicularly from the inner face 26 of the front wall 23, at opposed edges thereof. One skilled in the art will understand that when the corner molding members 22 are mounted to a support surface, the inner sidewall 32 and the outer sidewall sections 40 extend towards the support surface and the front wall 23 is spaced-apart from the support surface. It will be understood that the faces of the front wall 23, the inner sidewall 32 and the outer sidewall sections 40 which face outwards, may be referred as an external face 29 of the corner molding member 22.

The term "substantially perpendicularly" is used herein to reflect that, as will be described in more details below, in the illustrated embodiment, the inner sidewall 32 and outer sidewall sections 40 respectively extend perpendicularly and with a small obtuse angle relative from the inner face 26 of the front wall 23, but that, in alternative embodiment they could extend perpendicularly or form obtuse or acute angles relative from the inner face 26 of the front wall 23.

The corner molding member 22 further includes a fastening flange 30 extending outwardly from an inner edge of the inner sidewall 32. The fastening flange 30 is spaced apart from the front wall 23, the inner sidewall 32 extending therebetween, such that the fastening flange 30 is juxtaposed to the support surface when the corner molding member 22 is positioned to be secured to the support surface. As previously defined, the term "inner edge" refers to the edge of the sidewall 32 opposite from the front wall 23 and proximate to the support surface when the corner molding member 22 is positioned to be secured thereto.

In the embodiment shown, the inner sidewall 32 extends perpendicularly from the inner face 26 of the front wall 23, over the entire length of the corner molding member 22, i.e. from a lower edge to an upper edge thereof. However, one skilled in the art will understand that, in an alternative embodiment, the inner sidewall 32 could extend over a length shorter than the length of the corner molding member 22. Similarly, in an alternative embodiment, the length of the fastening flange 30 extending from the inner sidewall 32 could vary from the embodiment shown. In order to allow the securing of the corner molding member to a corresponding support surface (not shown), in the embodiment shown, the fastening flange 30 includes a plurality of spaced-apart fastening apertures 34. Nails or other appropriate fasteners can be inserted in the fastening apertures 34 for securing the corner molding member 22 to the support surface, as will be described in more details below.

Opposite to the inner sidewall 32, the corner molding member 22 comprises a plurality of protruding fingers 36 and recesses 38 provided in an alternate configuration, i.e. wherein a recess 38 is defined between two protruding fingers 36. As can be seen, the width of the front wall 23 is consequently smaller in a recess section than in a protruding finger section. Each one of the protruding fingers 36 and recesses 38 ends with a corresponding one of the outer sidewall sections 40 extending inwardly from the inner face 26 of the front wall 23. The edge region including the plurality of outer sidewall sections 40 of the plurality of protruding fingers 36 and recesses 38 defines a toothed edge region opposed to the edge region formed by the inner sidewall 32. In the embodiment shown, the outer sidewall sections 40 define a small obtuse angle with the front wall 23. As previously mentioned, in an alternative embodiment (not shown), the angle defined between the outer sidewall sections 40 and the front wall 23 can however differ from the embodiment shown.

In the illustrated embodiment, the outer face 24 of the front wall 23 and the outer sidewall sections 40 of the protruding finger 36 of each molding member 22 include a covering section 28 with simulated building elements in order to give a natural appearance to the assembled corner assembly 20 when assembled. In the embodiment shown, the simulated building elements are substantially rectangular stones mounted in an adjacent configuration. However, it will be understood that, in an alternative embodiment, the simulated building elements could be different from the illustrated rectangular stones. In an alternative embodiment, the covering section 28 may cover other sections of the external face 29 of the corner molding member 22.

Referring to FIG. 3, in the illustrated embodiment, the corner molding member 22 further comprises lips 42 extending outwardly from an inner edge of the outer sidewall sections 40 corresponding to the recesses 38. As can be seen, the lips 42 are spaced apart from the front wall 23, the outer sidewall sections 40 extending therebetween. Once again, the inner edge is located at the edge of the outer sidewall sections 40 opposite from the front wall and proximate to the support surface when the corner molding member 22 is positioned to be secured thereto. The purpose of the lips 42 will be described in more details below.

A plurality of inner walls 44 extends between the inner sidewall 32 and the outer sidewall sections 40. The length of the inner walls 44 vary in accordance if they extend in a section corresponding to one of the protruding fingers 36 or one of the recesses 38. Along their length, the inner walls 44 have indentations 46 defined therein. The indentations 46 extend inwardly from a free edge of the inner walls 44. In the embodiment shown, the inner walls 44 extending in a section corresponding to one of the protruding fingers 36 have two indentations 46 defined therein while the inner walls 44 extending in a section corresponding to one of the recesses 38 have one indentation 46 defined therein. The indentations 46 proximal to the inner sidewall 32 are aligned together. Similarly, in the embodiment shown, the indentations 46 proximal to the outer sidewalls 40 are also aligned together. One skilled in the art will understand that, in alternative embodiments, the amount, the shape, and the configuration of the indentations 46 can vary from the embodiment shown. For instance and without being limitative, in an embodiment, each inner wall 44 can include one or more indentations 46.

In FIGS. 2 and 3, only a first one of the two corner molding members 22 of the corner assembly 20 is described. As can be seen, a second one of the corner molding members 22 forming the corner assembly 20 has similar features to the corner molding member 22 described above and need not be described in further detail. One skilled in the art will understand that, the alternate protruding fingers 36 and recesses 38 of the second one of the molding members 22 are configured in a complementary configuration for engagement with the protruding fingers 36 and recesses 38 of the first one of the corner molding members 22 in a male-female configuration, as can be seen more clearly in FIG. 4.

In an embodiment, the two corner molding members 22 can be made using the same mold, thereby resulting in the two corner molding members 22 being identical. In use, one of the two corner molding members 22 is inverted, i.e. flipped upside down, to be complementary and engageable with the other one of the two corner molding members 22.

Figure 4:
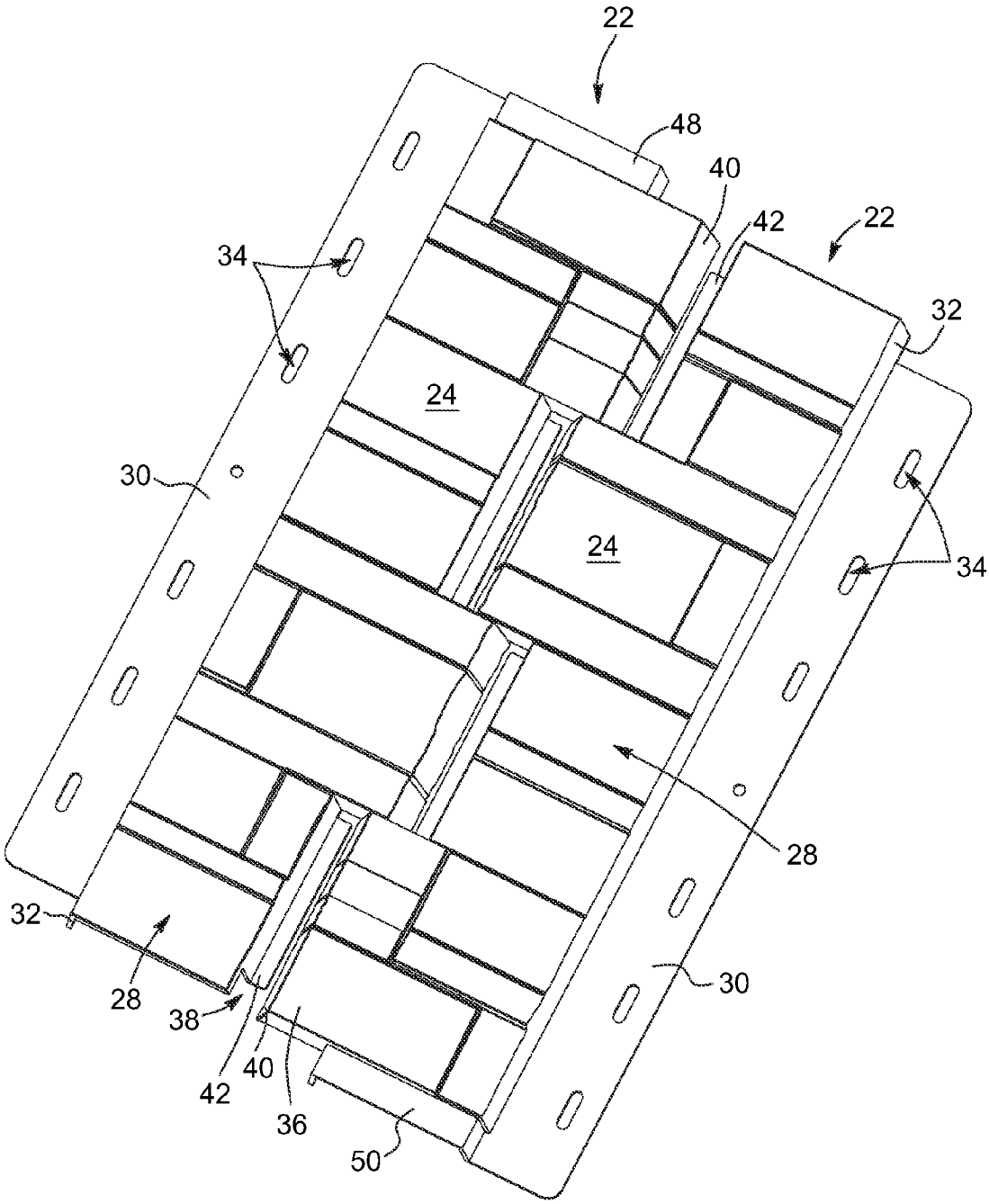
FIG. 4 is a front perspective view of the corner assembly shown in FIG. 1 wherein two corner molding members are being engaged together to define a corner.

Referring to FIGS. 2 to 4, in the illustrated embodiment, a first one of the two corner molding members 22 comprises a U-shaped wall extension 48 protruding from an upper edge of the respective one of the corner molding members 22 while the second one of the two corner molding members 22 comprises a U-shaped wall extension 50 protruding from a lower edge of the respective one of the corner molding members 22. In the embodiment shown, the U-shaped wall extensions 48, 50 extend from either a lower one or an upper one of the protruding fingers 36. The U-shaped wall extensions 48, 50 are configured to engage a vertically-adjacent corner molding member 22 of another corner assembly 20 when multiple corner assemblies 20 are mounted in a vertically stacked relation to each other. When vertically-adjacent corner molding members 22 are used, the U-shaped wall extensions 48, 50 of the corner molding members 22 of a first one of the corner assemblies 20 are covered by a section of the front wall 23 of the corner molding members 22 of vertically-adjacent corner assemblies 20.

One skilled in the art would understand that, in an alternative embodiment, only one of the corner molding members 22 includes a U-shaped wall extension 48,50 protruding from the upper or lower edge thereof.

FIG. 4 shows the two corner molding members 22 of the corner assembly 20 being engaged together to define a corner. In the illustrated embodiment, the two corner molding members 22 are positioned in an adjacent configuration with the protruding fingers 36 of a first corner molding member 22 being adjacent and interlocked with complementary recesses 38 of a second corner molding member 22 and the protruding fingers 36 of the second corner molding member 22 being adjacent and interlocked with complementary recesses 38 of the first corner molding member 22. In other words, the protruding fingers 36 of the first corner molding member 22 mesh with complementary recesses 38 of a second corner molding member 22 and the protruding fingers 36 of the second corner molding member 22 mesh with complementary recesses 38 of the first corner molding member 22.

In the embodiment shown, the corner molding members 22 are configured in a substantially straight configuration while being engaged together. It will be understood that, in alternative embodiments, an angle can be defined between the two corner molding members 22 when they are being engaged together.

Referring to FIGS. 1 and 6, once engaged together, the two corner molding members 22 can be pivoted either rearwardly to define an outside corner, as shown in FIG. 1, or forwardly to define an inside corner, as shown in FIG. 6. As can be seen, when the two corner molding members 22 are engaged together to either define an outside corner or an inside corner, the protruding fingers 36 of the corner molding members 22 remain interlocked.

Figure 5:
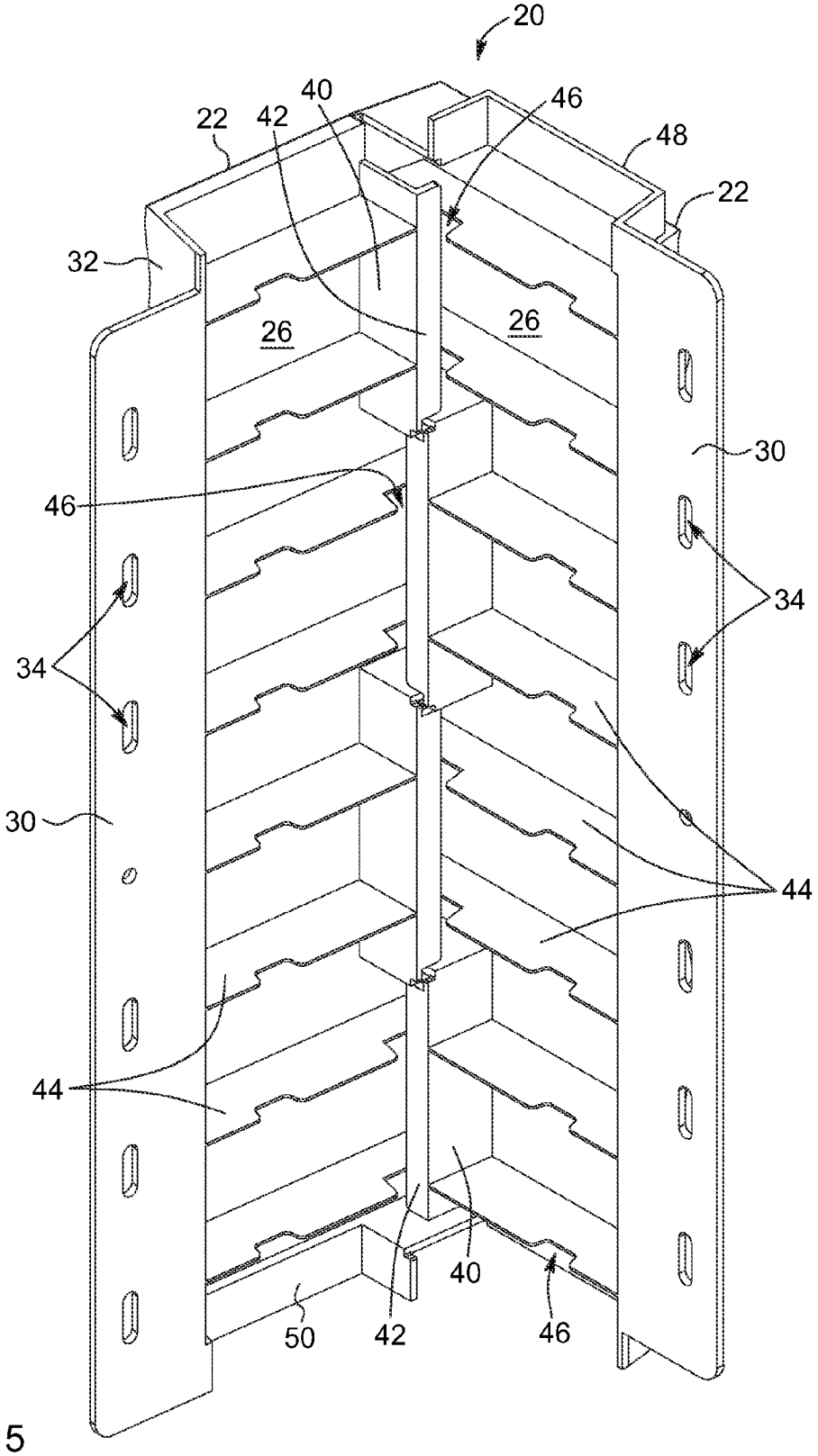
FIG. 5 is a rear perspective view of the corner assembly shown in FIG. 1.

Referring to FIG. 5, in an embodiment, when the corner molding members 22 are engaged together and define the outside corner, the lips 42 extending outwardly from the outer sidewall sections 40 of one of the corner molding members 22 are engaged in a respective one of the indentations 46 defined in the inner walls 44 of the other one of the corner molding members 22, in order to maintain the two corner molding members 22 engaged together. In other words, the lips 42 act as a male member and the indentations 46 act as female members with the male and female members being engageable together. One skilled in the art will understand that, in order to provide a greater flexibility in the angular positioning between the corner molding members 22, the length of the lips 42 and the depth of the indentations 46 can be varied.

Referring now to FIG. 6, in an embodiment, when the corner molding members 22 are engaged together and define the inside corner, the lips 42 of one of the corner molding members 22 are superposed to at least a portion of a respective one of the outer sidewall sections 40 of the protruding fingers 36 of the other one of the corner molding members 22. Moreover, the outer sidewall sections 40 of the recesses 38 of one of the corner molding members 22 are superposed to a section of the outer face 24 of the front wall 23 of the other one of the corner molding members 22 corresponding to the protruding fingers 36.

It will be understood that, even if in FIGS. 1 and 6, the corner molding members 22 are configured to define right angle corners, the angle defined between the two corner molding members 22 can be adjusted in accordance with the corner to be covered. For instance, the angle can vary between approximately 75° to 180°.

As previously mentioned, the plurality of panels of the covering system (not shown) can also include an outer face with simulated building elements. For instance, the building elements can include a plurality of vertically-adjacent, horizontally extending rows of shingles or other building elements such as wood planks, stones, slates, tiles, bricks, shingles such as cedar shingles, and the like. Similarly, the corner molding members 22 have an external face 29 with a covering section 28 including a plurality of simulated building elements, which, in a non-limitative embodiment, can correspond to the simulated building elements of the panels mounted adjacent thereto. In FIGS. 1 to 6, the texture of the building elements has been removed in order to improve the clarity thereof.

One skilled in the art would understand that in the embodiment shown in FIGS. 1 to 6, the front wall 23 has a thickness that is smaller than the thickness of the corner molding member 22, but that in an alternative embodiment, the thickness of the front wall 23 could be varied. Therefore, in an alternative embodiment, the inner sidewall 32 and the outer sidewall sections 40 could be considered to be part of the front wall 23, the inner sidewall 32 and the outer sidewall sections 40 being side sections extending in the thickness of the front wall 23.

A corner assembly 20 of a covering system, according to an embodiment having been described above, a method of covering a length of a corner formed by a first support surface and a second support surface using the above described corner assembly 20 will now be described.

For covering a corner formed at the junction of two support surfaces, two complementary corner molding members 22 are engaged together and configured to define a corner, either an inside corner or an outside corner, depending on the corner to be covered. The angle defined between the corner molding members 22 of the corner assembly 20 is adjusted in accordance with the angle of the corner to be covered. Subsequently, the assembled corner assembly 20 is superposed to the two meeting support surfaces and each one of the corner molding members 22 is secured to a respective one of the support surface by inserting nails or other fasteners into the fastening apertures 34.

As previously described, the corner molding members 22 are engaged to one another by interlocking at least one protruding finger 36 and at least one recess 38 of the first corner molding member with at least one corresponding protruding finger 36 and at least one corresponding recess 38 of the second corner molding member.

In order to cover a greater length of the corner, another corner assembly may be assembled, positioned in a vertically-adjacent position to the first and previously secured corner assembly, and secured to the support surfaces. The additional corner assembly is assembled by engaging a third corner molding member and a fourth corner molding member to one another using the above described steps. In an embodiment, the additional corner assembly is positioned in the vertically-adjacent position by inserting the respective upper and lower U-shaped wall extension 48, 50 behind the front wall 23 of the vertically-adjacent corner assembly 20.

The above steps may be repeated several times. Therefore, additional corner assemblies may also be assembled, positioned in a vertically-adjacent position to the previously mounted corner assemblies, and secured to the support surfaces until the corner is covered along its entire length.

Subsequently, covering panels are mounted to the support surfaces according to methods known in the art. Sections of the covering panels cover the fastening flanges 30 of the corner assemblies 20. The covering panels may have to be cut along their length in order to have a side edge positioned adjacent to the end of the front wall 23 adjacent to the inner sidewall 32.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A corner assembly for siding and roofing coverings, the corner assembly comprising two complementary corner molding members, each one of the two corner molding members having a front wall including a covering section with simulated building elements on an outer face thereof, at least one protruding finger and at least one recess, the at least one protruding finger and at least one recess being configured in an alternating configuration in order to interlock in a male-female configuration when the two complementary corner molding members are engaged with one another to define a corner each one of the two complementary corner molding members further comprising:

outer sidewall sections extending inwardly from the front wall at an edge of each one of the at least one protruding finger and the at least one recess;

a lip extending outwardly from an inner edge of each one of the outer sidewall sections corresponding to the at least one recess, the inner edge of each one of the outer sidewall sections corresponding to the at least one protruding finger being free of the lip.

2. The corner assembly of claim 1, wherein the two complementary corner molding members are selectively engageable in an inside corner configuration and an outside corner configuration.

3. The corner assembly of claim 1, wherein each one of the two complementary corner molding members further comprises a plurality of inner walls extending inwardly from the front wall, each one of the inner walls having at least one indentation defined therein engageable by a respective one of the lips of the other one of the corner molding members when the two complementary corner molding members are engaged in an outside corner configuration.

4. The corner assembly of claim 1, wherein the covering section with simulated building elements covers each one of the outer sidewall sections corresponding to the at least one protruding finger.

5. The corner assembly of claim 1, wherein at least one of the two complementary corner molding members further comprises a U-shaped wall extension extending from one of an upper edge and a lower edge thereof and having a front wall recessed from the covering section, and two side wall sections extending rearwardly from the front wall on each side of the front wall.

6. The corner assembly of claim 1, wherein each one of the two complementary corner molding members further comprises an inner sidewall extending inwardly from the front wall, at an edge opposed to the at least one protruding finger and the at least one recess, the inner sidewall including a fastening flange extending outwardly from an inner edge thereof.

7. The corner assembly of claim 6, wherein the fastening flange comprises a plurality of fastening apertures.

8. The corner assembly of claim 1, wherein the two complementary corner molding members are identical, one of the two complementary corner molding members being flipped upside-down prior to the engagement of the two complementary corner molding members.

9. The corner assembly of claim 1, wherein the lips are superposed to a corresponding one of the outer sidewall sections corresponding to the at least one protruding finger of the other one of the corner molding members when the two complementary corner molding members are engaged in an inside corner configuration.

10. The corner assembly of claim 1, wherein each one of the two complementary corner molding members further comprises an inner sidewall extending inwardly from the front wall, at an edge opposed to the at least one protruding finger and the at least one recess, the inner sidewall extending linearly and being free of protruding finger and recess configured in an alternating configuration.

11. A corner assembly for siding and roofing coverings, the corner assembly comprising a first corner molding member and a second corner molding member, each one of the first corner molding member and the second corner molding member having an external face including a covering section with simulated building elements, at least one protruding finger and at least one recess defining a toothed edge region, the at least one protruding finger and the at least one recess being configured in an alternating configuration, each one of the first corner molding member and the second corner molding member further comprising a lip extending outwardly from an inner edge of each one of the at least one recess of the toothed edge region and a fastening flange extending outwardly from an inner edge of an edge region opposed and spaced-apart from the toothed edge region; the first corner molding member and the second corner molding member being engageable together in a finger joint configuration wherein each of the at least one protruding finger of the first corner molding member is engaged in a respective one of the at least one recess of the second corner molding member and each of the at least one protruding finger of the second corner molding member is engaged in a respective one of the at least one recess of the first corner molding member to define a corner.

12. The corner assembly of claim 11, wherein the first corner molding member and the second corner molding member are selectively engageable in an inside corner configuration and an outside corner configuration.

13. The corner assembly of claim 11, wherein each one of the first corner molding member and the second corner molding member further comprises a plurality of inner walls having at least one indentation defined therein engageable by a respective one of the lips of the other one of the first corner molding member and the second corner molding member when the first corner molding member and the second corner molding member are engaged in an outside corner configuration.

14. The corner assembly of claim 11, wherein at least one of the first corner molding member and the second corner molding member further comprises a U-shaped wall extension extending from one of an upper edge and a lower edge thereof and having a front wall recessed from the covering section, and two side wall sections extending rearwardly from the front wall on each side of the front wall.

15. The corner assembly of claim 11, wherein the fastening flange comprises a plurality of fastening apertures.

16. The corner assembly of claim 11, wherein the first corner molding member and the second corner molding member are identical, one of the first corner molding member and the second corner molding member being flipped upside-down prior to the engagement of the two complementary corner molding members.

17. A method for covering a length of a corner defined at a junction of a first support surface and a second support surface, the method comprising the steps of:

assembling a corner assembly according to claim 11 by engaging the first corner molding member and the second corner molding member together, the corner molding members being engaged by interlocking at least one protruding finger and the at least one recess of the first corner molding member with the at least one corresponding protruding finger and the at least one corresponding recess of the second corner molding member;

configuring the corner assembly in one of an inside corner configuration and an outside corner configuration; and securing the corner assembly to the first support surface and the second support surface to cover the junction thereof by engaging fasteners in at least one of the fastening flanges of the first corner molding member and the second corner molding member.

18. The method of claim 17, further comprising the steps of:

assembling an additional corner assembly by engaging a third corner molding member and a fourth corner molding member together, the corner molding members being engaged by interlocking at least one protruding finger and at least one recess of the third corner molding member with at least one corresponding protruding finger and at least one corresponding recess of the fourth corner molding member;

configuring the additional corner assembly in the one of the inside corner configuration and the outside corner configuration;

positioning the additional corner assembly in a vertically-adjacent position with the previously secured corner assembly; and securing the additional corner assembly to the first support surface and the second support surface to cover the junction thereof.

19. The method of claim 18, wherein the steps are repeated until the length is covered.

20. The method of claim 18, wherein the step of positioning the additional corner assembly in a vertically-adjacent position with the previously secured corner assembly comprises the additional step of inserting at least one U-shaped wall extension extending from at least one of the previously secured corner assembly and the additional corner assembly behind the other one of the at least one of the previously secured corner assembly and the additional corner assembly, the at least one U-shaped wall extension having a front wall recessed from the covering section, and two side wall sections extending rearwardly from the front wall on each side of the front wall.

21. The corner assembly of claim 11, wherein the edge region, opposed to and spaced-apart from the toothed edge region, extends linearly and is free of protruding finger and recess configured in an alternating configuration.

22. A corner assembly for siding and roofing coverings, the corner assembly comprising two complementary corner molding members, each one of the two corner molding members having a front wall including a covering section with simulated building elements on an outer face thereof, at least one protruding finger and at least one recess, the at least one protruding finger and at least one recess being configured in an alternating configuration in order to interlock in a male-female configuration when the two complementary corner molding members are engaged with one another to define a corner, each one of the two complementary corner molding members further comprises outer sidewall sections extending inwardly from the front wall, at an edge of each one of the at least one protruding finger and the at least one recess, each one of the two complementary corner molding members further comprising a lip extending outwardly from an inner edge of each one of the outer sidewall sections corresponding to the at least one recess and a plurality of inner walls extending inwardly from the front wall, each one of the inner walls having at least one indentation defined therein engageable by a respective one of the lips of the other one of the corner molding members when the two complementary corner molding members are engaged in an outside corner configuration.

* * * * *